US011617910B2

(12) United States Patent
Evans

(10) Patent No.: US 11,617,910 B2
(45) Date of Patent: Apr. 4, 2023

(54) WORKOUT SYSTEMS AND METHODS USING ROBUST DOOR MOUNTING

(71) Applicant: Home Body Fitness, Inc., Seattle, WA (US)

(72) Inventor: Robert G. Evans, Seattle, WA (US)

(73) Assignee: HOME BODY FITNESS, INC., Seattle, WA (US)

( * ) Notice: Subject to any disclaimer, the term of this patent is extended or adjusted under 35 U.S.C. 154(b) by 228 days.

(21) Appl. No.: 16/954,991

(22) PCT Filed: Dec. 19, 2018

(86) PCT No.: PCT/US2018/066588

§ 371 (c)(1),
(2) Date: Jun. 17, 2020

(87) PCT Pub. No.: WO2019/126380

PCT Pub. Date: Jun. 27, 2019

(65) Prior Publication Data

US 2020/0376319 A1 Dec. 3, 2020

Related U.S. Application Data

(60) Provisional application No. 62/608,457, filed on Dec. 20, 2017.

(51) Int. Cl.
*A63B 21/04* (2006.01)
*A63B 21/00* (2006.01)
(Continued)

(52) U.S. Cl.
CPC ..... *A63B 21/0442* (2013.01); *A63B 21/0552* (2013.01); *A63B 21/1645* (2013.01);
(Continued)

(58) Field of Classification Search
CPC . A63B 21/04; A63B 21/0407; A63B 21/0414; A63B 21/0421; A63B 21/0428;
(Continued)

(56) References Cited

U.S. PATENT DOCUMENTS 6,322,483 B1 11/2001 Rotella
6,908,418 B2 6/2005 Sauré
(Continued)

FOREIGN PATENT DOCUMENTS

CA 2387149 A1 5/2003
DE 202012101216 U1 6/2012
(Continued)

OTHER PUBLICATIONS https://www.homedepot.com/p/Cargo-Boss-16-ft-x-2-in-3-300-lbs-Ratchet-Tie-Down-137690/204636844, dated May 16, 2015 (Year: 2015).*
(Continued)

*Primary Examiner* — Gary D Urbiel Goldner
(74) *Attorney, Agent, or Firm* — AEON Law, PLLC; Adam L. K. Philipp; Jonathan E. Olson

(57) ABSTRACT

Methods and systems are presented in which one or more heavy-duty straps are positioned in contact with a top and bottom of a door and engaged with a heavy mechanism exerting a static tension greater than 10 newtons. A user can exercise using removable extenders attached to any of several loops at various vertical positions, creating enormous leverage along the strap(s). Supplemental cushioning may be utilized to minimize damage from large kinetic energy imbued upon components of the methods and systems during or after exercise.

15 Claims, 10 Drawing Sheets

(51) Int. Cl.
*A63B 21/055* (2006.01)
*A63B 21/16* (2006.01)
*A63B 23/035* (2006.01)

(52) U.S. Cl.
CPC .... *A63B 21/4035* (2015.10); *A63B 23/03541* (2013.01); *A63B 2209/00* (2013.01); *A63B 2220/12* (2013.01); *A63B 2220/806* (2013.01); *A63B 2220/833* (2013.01); *A63B 2225/20* (2013.01)

(58) Field of Classification Search
CPC ..... A63B 21/0435; A63B 21/0442; A63B 21/055; A63B 21/0552; A63B 21/0555; A63B 21/0557; A63B 21/15; A63B 21/157; A63B 21/16; A63B 21/1618; A63B 21/1645; A63B 21/4027; A63B 21/4033; A63B 21/4035; A63B 23/035; A63B 23/03516; A63B 23/03533; A63B 23/03541; A63B 23/12; A63B 24/0062; A63B 2024/0065; A63B 2024/0068; A63B 71/0036; A63B 71/0054; A63B 71/04; A63B 71/0619; A63B 71/0622; A63B 2071/009; A63B 2071/0625; A63B 2071/063; A63B 2071/0647; A63B 2071/0658; A63B 2071/0675; A63B 2071/068; A63B 2071/0694; A63B 2209/00; A63B 2210/00; A63B 2210/50; A63B 2220/83; A63B 2220/833; A63B 2225/09; A63B 2225/093; A63B 2225/68; A63B 2225/685
See application file for complete search history.

(56) References Cited

U.S. PATENT DOCUMENTS

| | | | | |
|---|---|---|---|---|
| 7,963,368 | B2 | 6/2011 | Scudera et al. | |
| 8,038,581 | B1 | 10/2011 | Sudeith | |
| 9,656,111 | B1 | 5/2017 | Biddle | |
| 2004/0087420 | A1 | 5/2004 | Montesquieux | |
| 2010/0304695 | A1 | 12/2010 | Persson et al. | |
| 2013/0184124 | A1 | 7/2013 | Reed | |
| 2015/0094046 | A1 | 4/2015 | Jung et al. | |
| 2015/0099613 | A1 | 4/2015 | Saez | |
| 2016/0207440 | A1 | 7/2016 | Kingery | |
| 2017/0087435 | A1 | 3/2017 | Jones et al. | |
| 2017/0296861 | A1 | 10/2017 | Burkinshaw | |
| 2017/0304695 | A1* | 10/2017 | Murray | A45C 13/005 |
| 2017/0348583 | A1 | 12/2017 | Darmour et al. | |
| 2018/0311563 | A1* | 11/2018 | Martin | G06K 9/00496 |

FOREIGN PATENT DOCUMENTS

| | | |
|---|---|---|
| WO | 9910048 A1 | 3/1999 |
| WO | 2019126380 | 6/2019 |

OTHER PUBLICATIONS

International Search Report dated Mar. 14, 2019, for PCT/US18/66588 filed Dec. 19, 2018.
Written Opinion dated Mar. 14, 2019, for PCT/US18/66588 filed Dec. 19, 2018.

* cited by examiner

WORKOUT SYSTEMS AND METHODS USING ROBUST DOOR MOUNTING

CROSS-REFERENCE TO RELATED APPLICATIONS

This application claims the benefit of U.S. provisional patent application Ser. No. 62/608,457 ("Around the Door Workout System") filed 20 Dec. 2018, incorporated in its entirety for all purposes.

BACKGROUND

So-called "home fitness" devices exist which promote resistance training: dumbbells, kettlebells, pull up bars and door anchors are classic examples. Dumbbells and kettlebells require different weights for different exercises creating a need for a cumbersome set of weights. Those devices which have an adjustable weight mechanism are expensive to produce and heavy, making them difficult to transport.

Pull-up bars will either take up space when attached to a standalone unit or when placed inside a door frame will prevent a door from closing because they will take up the space that a door would normally occupy. They may also cause damage to the frame.

Other devices create mechanical advantage from the strength of a door frame by use of a door anchor or anchors, which will hold in place a strap thin enough to sit in the spacing between a closed door and its frame, while the user exercises on the opposite side of the placed anchor. Door anchors work for attachment to both elastic bands and inelastic straps in the case of devices like double anchor adjustable gymnastic rings and their single anchor bifurcating strap derivatives.

A door anchor can function at any spot on the perimeter of a closed door, however inelastic straps are used almost exclusively between the uppermost, short sided section of a door and frame, whereas elastic bands are typically used anywhere on the non-hinge, long side of a door.

Other products involve a strap or straps which wrap around a door allowing the user to hook up bands or straps to different points along the strap. Some of these products are difficult to set up and may cause damage to a door. Others do not stay tight to the door due to the lack of a suitable force multiplying tightening mechanism. In the case of the latter, the user may experience significant uncertainty when they apply force to extending pieces away from the door as the strap physically separates significantly from the door.

Inelastic straps promote body weight, suspension type exercises, meaning at least a portion of the user's body weight is suspended, or in many cases supported, by what are typically handles attached to inelastic straps anchored to the top of a door. Such anchors may fall out when the door is opened. If this occurs unexpectedly when the straps are in use, the anchors may fly out rapidly, potentially causing serious injury or death.

In addition to serious risks like the foregoing, elastic bands have a further disadvantage in that their use generally includes changing the height of the anchor. Thus to perform a reasonable variety of exercises in a single session users must repeatedly open and close the door to reposition the anchor. This is a significant disadvantage to some users and an unworkable circumstance to others.

DESCRIPTION

Figure 1:
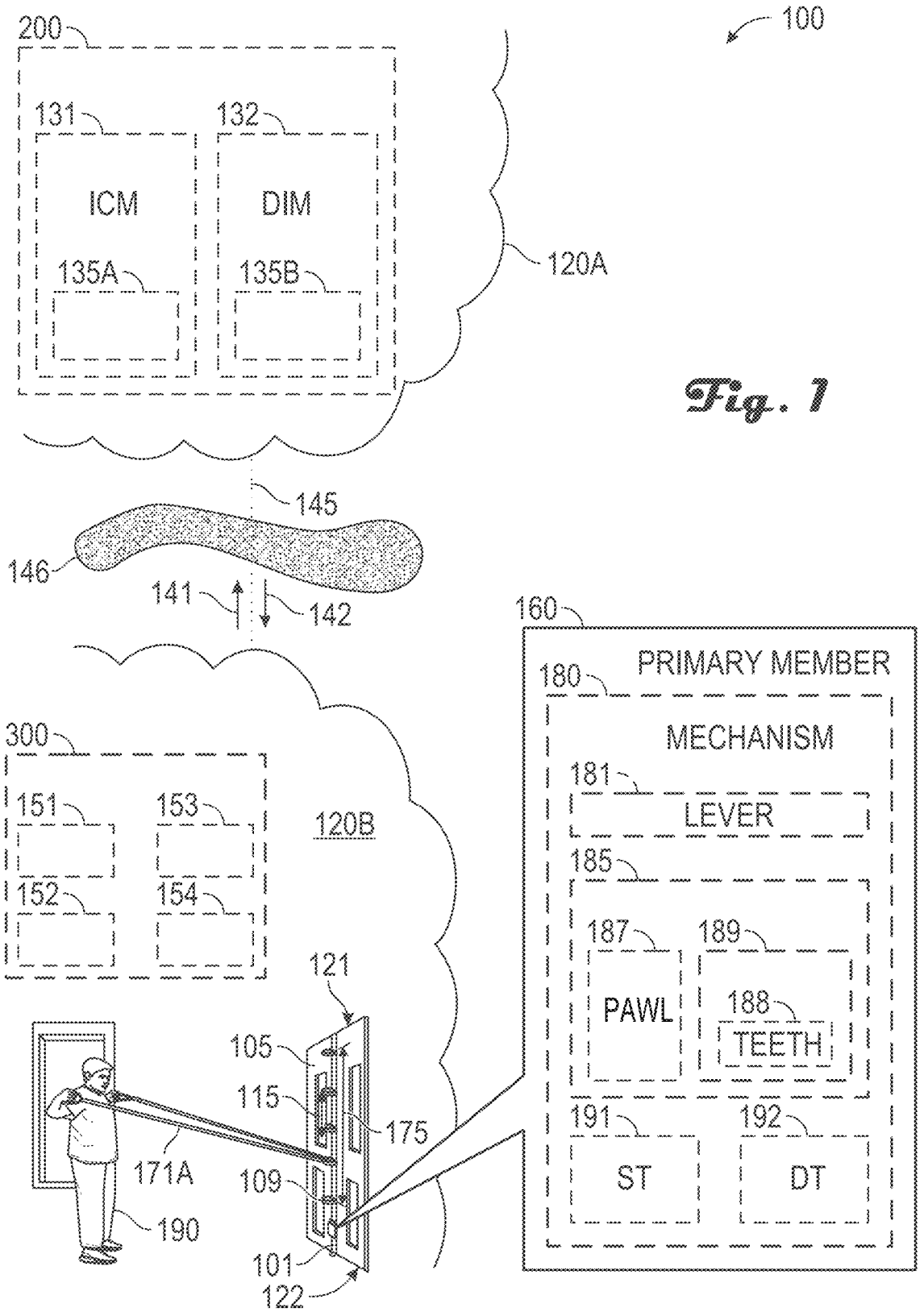
FIG. 1 illustrates an exercise system configured to engage a door and thereby repurpose an indoor space in which one or more technologies may be implemented.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise.

"Additional," "adjacent," "adjusted," "advancing," "alternatively," "arranged," "attached," "auditory," "back," "before," "both," "caused," "central," "closed-chain," "comprising," "conditional," "configured," "contained," "contiguous," "covered," "during," "dynamic," "elastic," "end," "engaging," "enormous," "exceeding," "extending," "factory-built," "flexible," "force-multiplying," "greater," "gripped," "hanging," "heavy," "herein," "hinged," "inelastic," "inward," "large," "less," "limited," "local," "mobile," "more," "moved," "narrow," "nominal," "numerous," "off-site," "onsite," "open," "open-chain," "outward," "over," "overlapping," "portable," "possible," "prevented," "primary," "projecting," "protective," "real time," "remaining," "retracted," "revealed," "robust," "single," "spanning," "static," "substantially," "suddenly," "sufficient," "supported," "thereof," "therethrough," "through," "tightening," "top," "under," "various," "vertical," "visible," "wherein," "while," "wider," "wireless," "within," "without," or other such descriptors herein are used in their normal yes-or-no sense, not merely as terms of degree, unless context dictates otherwise. In light of the present disclosure those skilled in the art will understand from context what is meant by "configured" or "enough" and by other such relational descriptors used herein.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Turning now to FIG. 1, there is shown a system 100 configured to repurpose a bedroom, office, hallway or other indoor space (as a local facility 120B, for example) to facilitate one or more open chain exercises (wood choppers, for example) or closed chain exercises (or both) performed by one or more local users 190. In some variants such facilitation may include interaction with a cloud server or remote server 200 (at a central facility 120A, for example). An image capture module 131 may (optionally) be configured to allow a live instructor of other human consultant to view image data 135A (video clips, e.g.) obtained via upload 141 via (one or more cameras of) a client device 300 local to the exercise space. Alternatively or additionally a dialog initiation 132 resident on a server may provide real-time feedback data 135B (transmitted via a wireless linkage 145 as a download 142 across a free space medium 146, e.g.).

In some contexts such feedback data 135B may include (one or more instances of) auditory guidance 151, visual guidance 152, a structured dialog 153, or safety information 154 (an email message sent as a conditional response to an upload 141 that indicates equipment is not being used safely, e.g.). Alternatively or additionally, such interactions may include synchronization signals (signaling an appropriate speed for doing an exercise, e.g.).

As shown the exercise space is bounded by a door 105 upon which is mounted a primary member 160 having one or more inelastic straps 101 in contact with a top 121 and bottom 122 thereof. In some variants the one or more inelastic straps 101 may be (1) greater than 2.5 centimeters in width, (2) up to about 1 millimeter in thickness, (3) wrapped diagonally around corners of the door 105 or vertically as shown, (4) more than 50% woven polymer by weight, or (5) more than one of these.

As shown one or more primary members 160 may each include one or more force-multiplying tightening mechanisms 180 by which longitudinal leverage 115 may be artificially amplified. One or more clampable levers 181 may be configured to exert a static tension 191 greater than 10 newtons upon the primary member 160 and thereby upon the top 121 and bottom 122 of the door 105 so as to avoid slippage. In some variants, for example, such levers may be configured to engage a ratchet 185 having a pawl 187 configured to engage a rotary succession of teeth 188 surrounding a gear 189. As shown a series of several loops 109 are provided at various vertical positions spanning a vertical range 175 greater than one meter. When pulled upon via an extension 171A clipped to one or more of the loops 109, moreover, a dynamic tension 192 on the order of 1 kilonewton may be exerted longitudinally via the primary member 160 upon the top 121 and bottom 122 of the door 105.

As used herein a value is "on the order of" another if they differ by less than a factor of ten (i.e. an order of magnitude). As used herein "substantially inelastic" refers to materials or structures that elongate less than 10% when pulled with a force of 100 newtons and "nominally inelastic" refers to materials or structures that elongate less than 5% when pulled with such a force. Unqualifiedly "inelastic" likewise refers to materials or structures that elongate less than 5% when pulled with such a force. As used herein "elastic" refers to materials or structures that elongate at least 10% when pulled with such a force. As used herein, a plain reference numeral (like 171, e.g.) may refer generally to a member of a class of items (like extensions, e.g.) exemplified with a hybrid numeral (like 171A, e.g.) and it will be understood that every item identified with a hybrid numeral is also an exemplar of the class.

Figure 2:
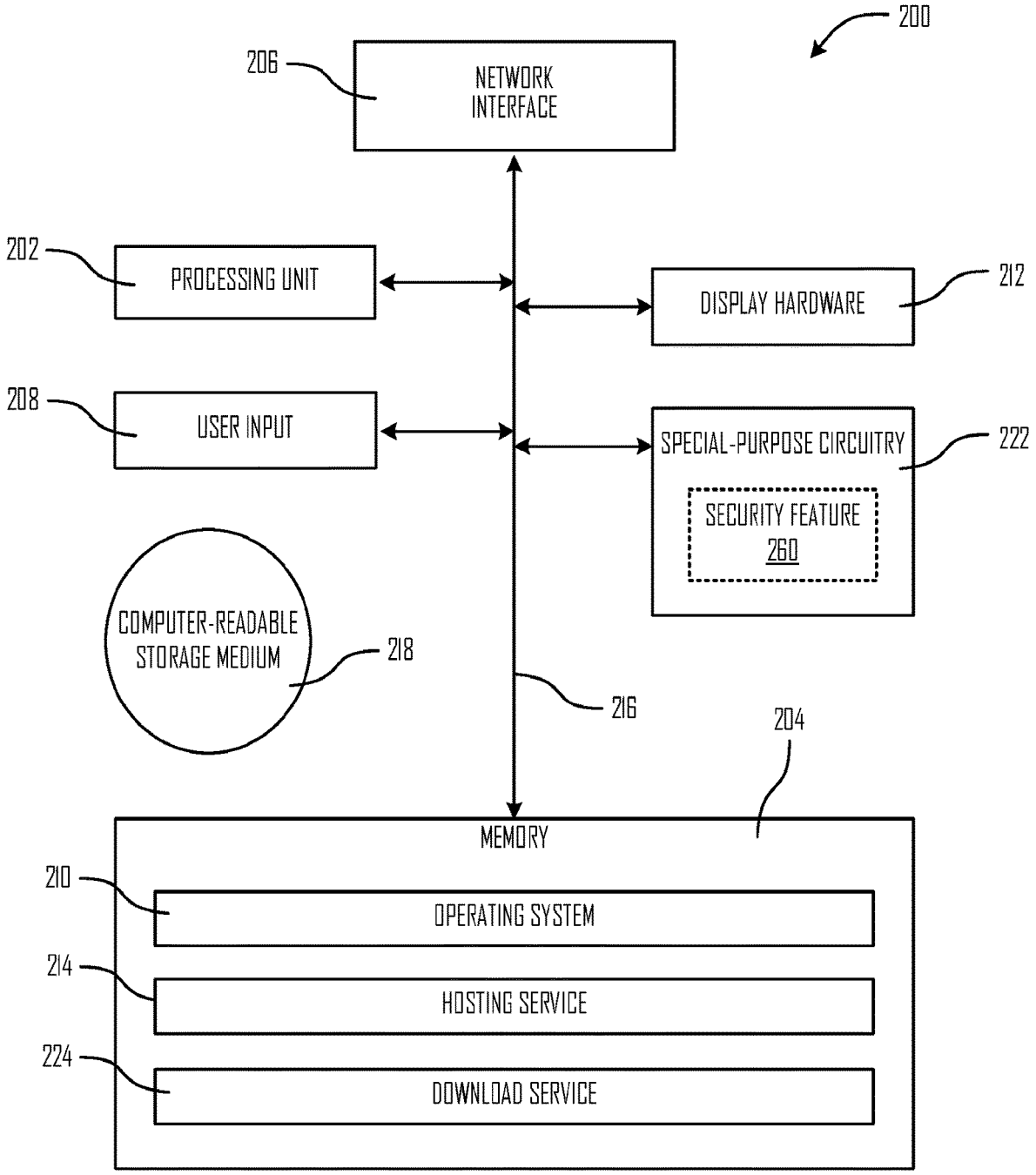
FIG. 2 illustrates several components of an exemplary server in which one or more technologies may be implemented.

FIG. 2 illustrates several components of an exemplary server 200 (like that of FIG. 1, e.g.). In some embodiments, server 200 may include many more components than those shown in FIG. 2. However, it is not necessary that all conventional components be shown in order to disclose an illustrative embodiment. As shown in FIG. 2, one or more servers 200 include a data network interface 206 (for connecting via the Internet or other networks to or within respective facilities 120A-B of FIG. 1, e.g.). Server 200 may also include one or more instances of processing units 202, memory 204, user inputs 208, and display hardware 212 all interconnected along with the network interface 206 via a bus 216. Memory 204 generally comprises a random access memory ("RAM"), a read only memory ("ROM"), and a permanent mass storage device, such as a disk drive.

Memory 204 may likewise contain one or more instances of operating systems 210, hosting services 214, download services 224, or other modules. This can occur, for example, in a context in which such servers 200 implement an Internet of Things (IoT) hub, for example. These and other digital components may be loaded from a non-transitory computer readable storage medium 218 into memory 204 of the server 200 using a drive mechanism (not shown) associated with a non-transitory computer readable storage medium 218, such as a floppy disc, tape, DVD/CD-ROM drive, flash card, memory card, or the like. In some embodiments, digital components may also be loaded via the network interface 206, rather than via a computer readable storage medium 218. Special-purpose circuitry 222 may, in some variants, include some or all of the event-sequencing logic described below and one or more security features 260 (e.g. for preventing digital hacks).

Such special-purpose circuitry 222 may (optionally) be implemented as an Application-Specific Integrated Circuit (ASIC) or in a UI governance server, e.g.—in which some or all of the functional modules described below may be implemented. Transistor-based circuitry comprises one or more instances of an event-sequencing structure generally as described in U.S. Pat. Pub. No. 20150094046 but configured as described herein. Circuitry 222 includes one or more instances of pattern recognition module, for example, each including an electrical node set upon which one or more (instances of) responses, identifiers, descriptions, alarms, or other informational indications are represented digitally as a corresponding voltage configuration. Moreover one or more such modules may be configured to generate one or more rankings by comparing image data or other performance indications against one or more designer-defined exercise patterns (provided by an onsite camera or microphone, e.g.), all within the abilities of one of ordinary skill without any undue experimentation in light of teachings herein.

Figure 3:
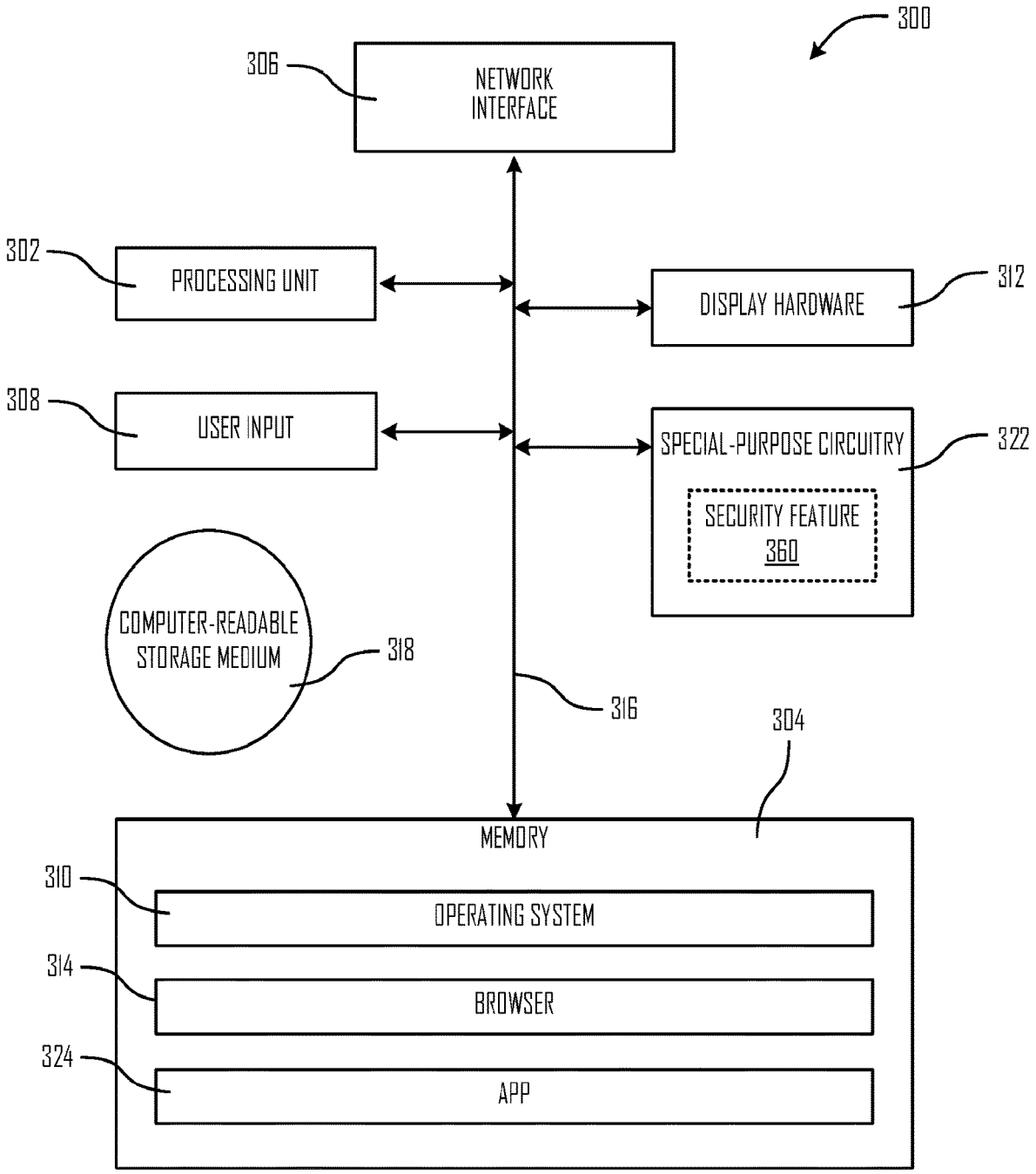
FIG. 3 illustrates several components of an exemplary client device in which one or more technologies may be implemented.

FIG. 3 illustrates several components of an exemplary client device 300 (like that of FIG. 1, e.g.). In some embodiments, client device 300 may include many more components than those shown in FIG. 3. However, it is not necessary that all conventional components be shown in order to disclose an illustrative embodiment. As shown in FIG. 3, client device 300 includes a data network interface 306 (for connecting via the Internet or other networks to or within respective facilities 120A-B of FIG. 1, e.g.). Client device 300 may also include one or more instances of processing units 302, memory 304, user inputs 308, and display hardware 312 all interconnected along with the network interface 306 via a bus 316. Memory 304 generally comprises a random access memory ("RAM"), a read only memory ("ROM"), and a permanent mass storage device, such as a disk drive.

Memory 304 may likewise contain one or more instances of operating systems 310, browsers 314 (configured to interact with a hosting service 214, e.g.), or other local apps 324 or additional modules or other updates (of operational settings, e.g.) downloaded from a download service 224 at central facility 120A. This can occur, for example, in a context in which such devices 300 implement an Internet of Things (IoT) hub, for example, or a building-mounted or handheld device. These and other digital components may be loaded from a non-transitory computer readable storage medium 318 into memory 304 of the client device 300 using a drive mechanism (not shown) associated with a non-transitory computer readable storage medium 318, such as a floppy disc, tape, DVD/CD-ROM drive, flash card, memory card, or the like. In some embodiments, digital components may also be loaded via the network interface 306, rather than via a computer readable storage medium 318. Special-purpose circuitry 322 may, in some variants, include some or all of the event-sequencing logic described below and one or more security features 360 (e.g. for preventing digital hacks).

Such special-purpose circuitry 322 may (optionally) be implemented as an Application-Specific Integrated Circuit (ASIC)—in which some or all of the functional modules described below may be implemented. Transistor-based circuitry comprises one or more instances of an event-sequencing structure generally as described in U.S. Pat. Pub. No. 20150094046 but configured as described herein. Circuitry 322 includes one or more instances of pattern recognition module, for example, each including an electrical node set upon which one or more (instances of) responses, identifiers, descriptions, alarms, or other informational indications are represented digitally as a corresponding voltage configuration. Such modules may include or otherwise interact with one or more cameras or other sensors, moreover, or may implement a Global Positioning System (GPS) tracker by which a mobile device may be located. Moreover one or more such modules may be configured to generate one or more Boolean indications by comparing quantified sensor data or other indications against one or more designer-defined thresholds, all within the abilities of one of ordinary skill without any undue experimentation in light of teachings herein.

In the interest of concision and according to standard usage in information management technologies, the functional attributes of modules described herein are set forth in natural language expressions. It will be understood by those skilled in the art that such expressions (functions or acts recited in English, e.g.) adequately describe structures identified below so that no undue experimentation will be required for their implementation. For example, any records or other informational data identified herein may easily be represented digitally as a voltage configuration on one or more electrical nodes (conductive pads of an integrated circuit, e.g.) of an event-sequencing structure without any undue experimentation. Each electrical node is highly conductive, having a corresponding nominal voltage level that is spatially uniform generally throughout the node (within a device or local system as described herein, e.g.) at relevant times (at clock transitions, e.g.). Such nodes (lines on an integrated circuit or circuit board, e.g.) may each comprise a forked or other signal path adjacent one or more transistors. Moreover many Boolean values (yes-or-no decisions, e.g.) may each be manifested as either a "low" or "high" voltage, for example, according to a complementary metal-oxide-semiconductor (CMOS), emitter-coupled logic (ECL), or other common semiconductor configuration protocol. In some contexts, for example, one skilled in the art will recognize an "electrical node set" as used herein in reference to one or more electrically conductive nodes upon which a voltage configuration (of one voltage at each node, for example, with each voltage characterized as either high or low) manifests a yes/no decision or other digital data.

Figure 4:
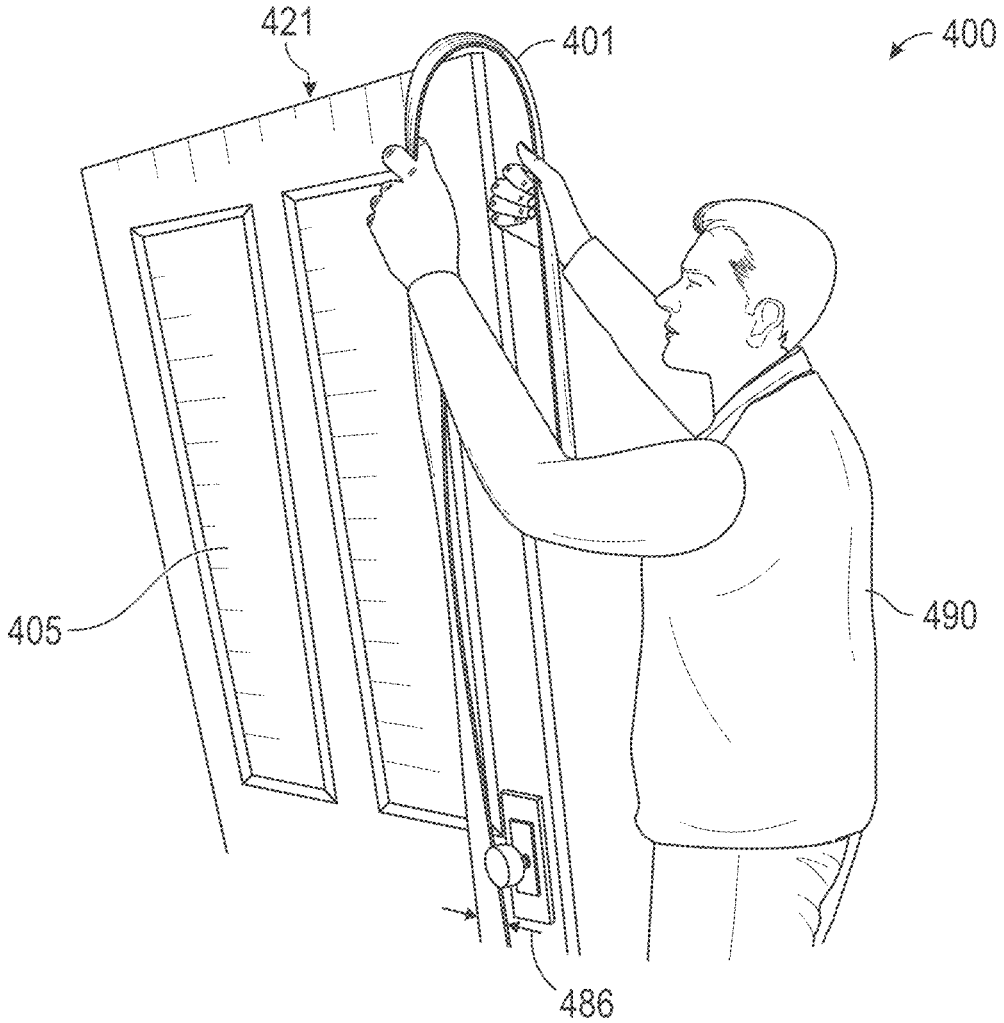
FIG. 4 illustrates another exercise system featuring a user installing a strap of a primary member, in which one or more technologies may be implemented.

FIG. 4 depicts another system 400 configured to repurpose an indoor space to facilitate exercises performed by one or more users 490, optionally as an instance of system 100. In some variants the exercise space is bounded by a door 405 upon which is mounted (a primary member that includes) one or more inelastic straps 401 in contact with a top 421 and bottom thereof. In some variants the one or more inelastic straps 401 as shown may be (1) greater than 3 centimeters in width, (2) about 1 millimeter in thickness 486, (3) wrapped diagonally around opposite corners of the door 405 or vertically, (4) more than 50% woven polymer by weight, or (5) more than one of these. Alternatively or additionally such primary members may each include one or more force-multiplying tightening mechanisms 180 by which longitudinal leverage 115 may be artificially amplified, such as with one or more clampable levers 181 configured to exert a static tension 191 greater than 20 newtons upon the primary member and thereby upon the top 421 and bottom of the door 405 so as to avoid slippage. Moreover when so mounted and pulled (generally laterally, i.e. less than 45 degrees from horizontal) upon via an extension 171, a dynamic tension 192 on the order of 1 kilonewton may be exerted longitudinally (i.e. generally vertically or diagonally within 45 degrees) via the primary member 160 upon the top 421 and bottom of the door 405.

Figure 5:
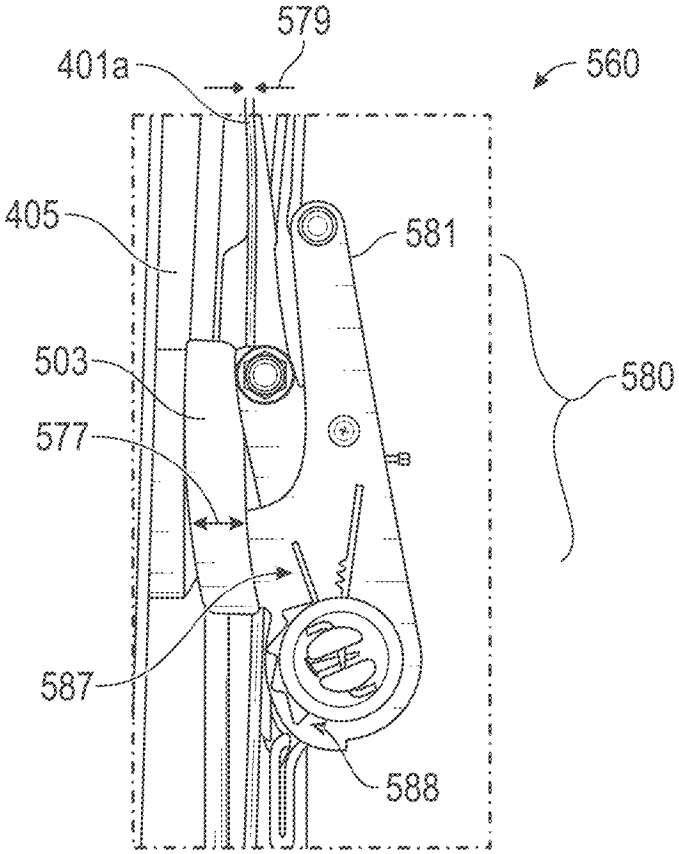
FIG. 5 illustrates another example of a primary member configured to engage a door, in which one or more technologies may be implemented.

FIG. 5 depicts another example of a primary member 560 usable in system 400, optionally as an instance of primary member 160, mounted on a door 405. Primary member 560 includes one or more inelastic straps 401A in contact with door 405. As shown the one or more inelastic straps 401A are each greater than 3 centimeters in width and about 1 millimeter in thickness 579. Primary member 560 also includes one or more force-multiplying tightening mechanisms 580 (on either side of the door 405) by which longitudinal leverage 115 manually exerted by a user 490 (see FIG. 9) may be artificially amplified (doubled or more, e.g.). As shown a ratcheting lever 581 may be configured to exert a static tension 191 greater than 10 newtons upon the primary member 560 and thereby upon the top and bottom of the door 405 so as to avoid slippage during use. In some variants, for example, such levers may be configured to engage a ratchet 185 having a pawl 587 configured to engage a rotary succession of ten or more teeth 588 surrounding a gear 189, wherein the tightening mechanism 180, 580 is factory-built as a single contiguous hinged force-multiplying assembly having a total mass exceeding 200 grams; and wherein the teeth 588 are sufficiently numerous so that each is configured to limit (in conjunction with the pawl 587 a backward rotation of the gear 189 to an amount less than 45 degrees. This can occur, for example in a context in which the first tightening mechanism 180, 580 is adhered or otherwise affixed to a sponge or other viscoelastic cushion 503; in which the cushion 503 is thick enough to prevent the first tightening mechanism 180, 580 from touching or damaging the door 405 even when a lateral force of more than 50 newtons exerted upon by an extension 171 upon the one or more inelastic straps 401A is suddenly released (after an exercise, e.g.); and wherein such a massive tightening mechanism 180, 580 would otherwise damage the door 405. In some contexts, for example, the cushion 503 may comprise a viscoelastic layer or a fabric padding layer (or both) having a median thickness 577 of about 1 millimeter. (As used herein "about" indicates a positive or other numerical difference having a margin of less than 50% unless context dictates otherwise.) Alternatively or additionally, a system 100, 400 as described herein may (optionally) be configured so that all athletic exercises in which primary member 560 is used are performed with only one strap 401A engaging the door 405 (i.e. with a single inelastic strap 401A engaging both the top and bottom of the door).

Figure 6:
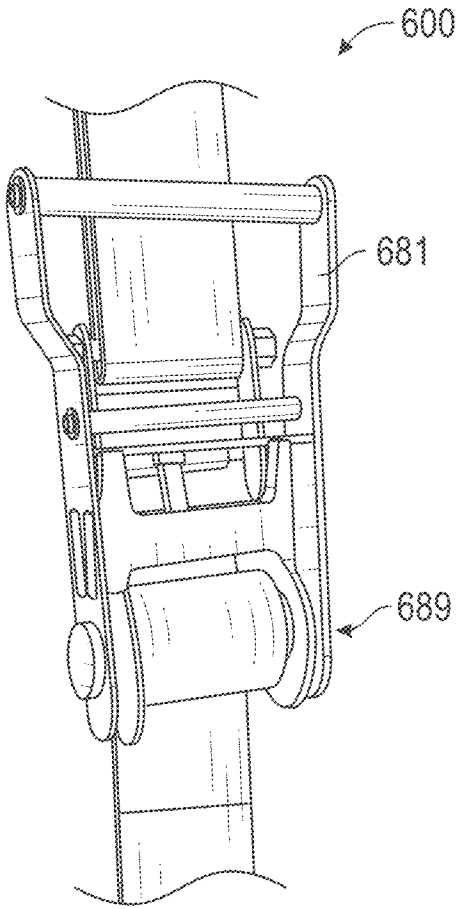
FIG. 6 illustrates another configuration of a primary member in which one or more technologies may be implemented.

FIG. 6 depicts another example of a primary member 660 usable in system 400, optionally as an instance of primary member 160. Primary member 660 includes one or more inelastic straps 401A (consisting of a webbing 611 more than half of which, by weight, is a synthetic polymer such as nylon, e.g.). As shown the one or more inelastic straps 401A are each greater than 2.5 centimeters in width and about 1 millimeter in thickness 579. Primary member 660 also includes one or more force-multiplying tightening mechanisms by which longitudinal leverage 115 manually exerted by a user 190, 490 (see FIG. 9) may be artificially amplified. As shown a lever 581, 681 may be configured to engage a ratchet 185 having a pawl 587 configured to engage a rotary succession of numerous teeth surrounding a gear 689, wherein the tightening mechanism is built as a single hinged force-multiplying assembly having a total mass exceeding 200 grams; and wherein the teeth are sufficiently numerous so that each is configured to limit (in conjunction with the pawl 587 a backward rotation of the gear 689 to an amount less than 45 degrees. This can occur, for example in a context in which all athletic exercises in which primary member 660 is used are performed without any other mechanical systems (other than hinges) affixed to the door.

Figure 7:
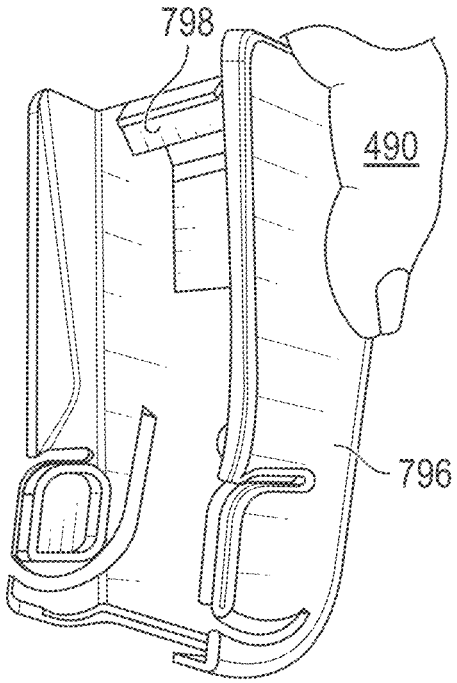
FIG. 7 illustrates a casing configured (at least partly) to cover the primary member of FIG. 6, in which one or more technologies may be implemented.

FIG. 7 depicts an acrylic casing 796 held by user 490 and suitable for (at least partly) covering primary member 660. One or more lips 798 thereof fit over (a horizontal portion of) lever 681 as shown.

Figure 8:
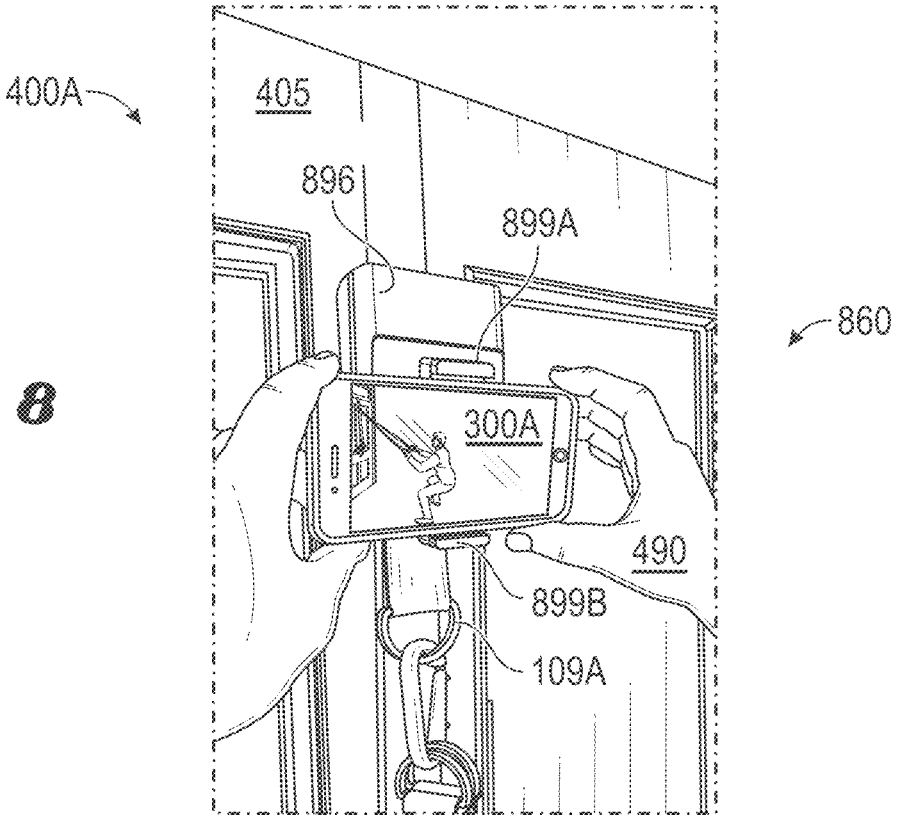
FIG. 8 illustrates another exercise system featuring a user installing a handheld mobile device, in which one or more technologies may be implemented.

FIG. 8 depicts a system 400A (as an instance of the system 400 of FIG. 4, e.g.) configured to repurpose an indoor space to facilitate exercises performed by one or more users 490. One or more substantially inelastic straps 401 thereof are in contact with a top 421 and bottom of the door 405. In addition to one or more features depicted in FIGS. 1-6 (this instance of) primary member 860 includes a mounting 896 having one or more grippers 899A-B configured to securely support a mobile client device 300A configured to present auditory or visual guidance 151-152 or to handle other digital information. In some variants this may include a structured dialog 153 presenting auditory options and having a limited local vocabulary of less than 100 utterance patterns. This can implement several numbered options recognizable via a speech recognition module (as a component of app 324, e.g.) functioning within facility 120B, for example, without requiring any remote communication (with device 300A in airplane mode, e.g.). Alternatively or additionally such digital information may include safety information 154 relating to installing system 400A or even synchronizing a performance of a series of exercises with auditory or visual guidance while the mobile device 300A is mechanically supported by mounting 896. This can occur, for example, in a context in which the mobile device 300A is supported by the door within a field of view of a user 190, 490 while the user is performing at least one of the exercises (e.g. see FIG. 1, 10, or 11), in which large horizontal (components of) forces are exerted (as dynamic tension 192, e.g.) via one or more extensions 171 engaging one or more loops 109A during the exercises, in which a sudden release of such extension(s) 171 would—with a more conventional design—result in mobile client device 300A suddenly becoming dislodged, and in which such problems are prevented by one or more effective mounting technologies described herein. In a context in which mounting 896 provides more than 200 grams of ballast, for example by implementing a casing 796 supporting a heavy-duty ratchet assembly, such ballast may be sufficient to prevent mobile client device 300A from becoming dislodged. Alternatively or additionally, such accidents may be prevented in some variants by mounting the mobile client device 300A within 30 centimeters of the top 421 of the door 405 as shown or by providing one or more supplemental cushions 503 adjacent the door 405 (or both).

Figure 9:
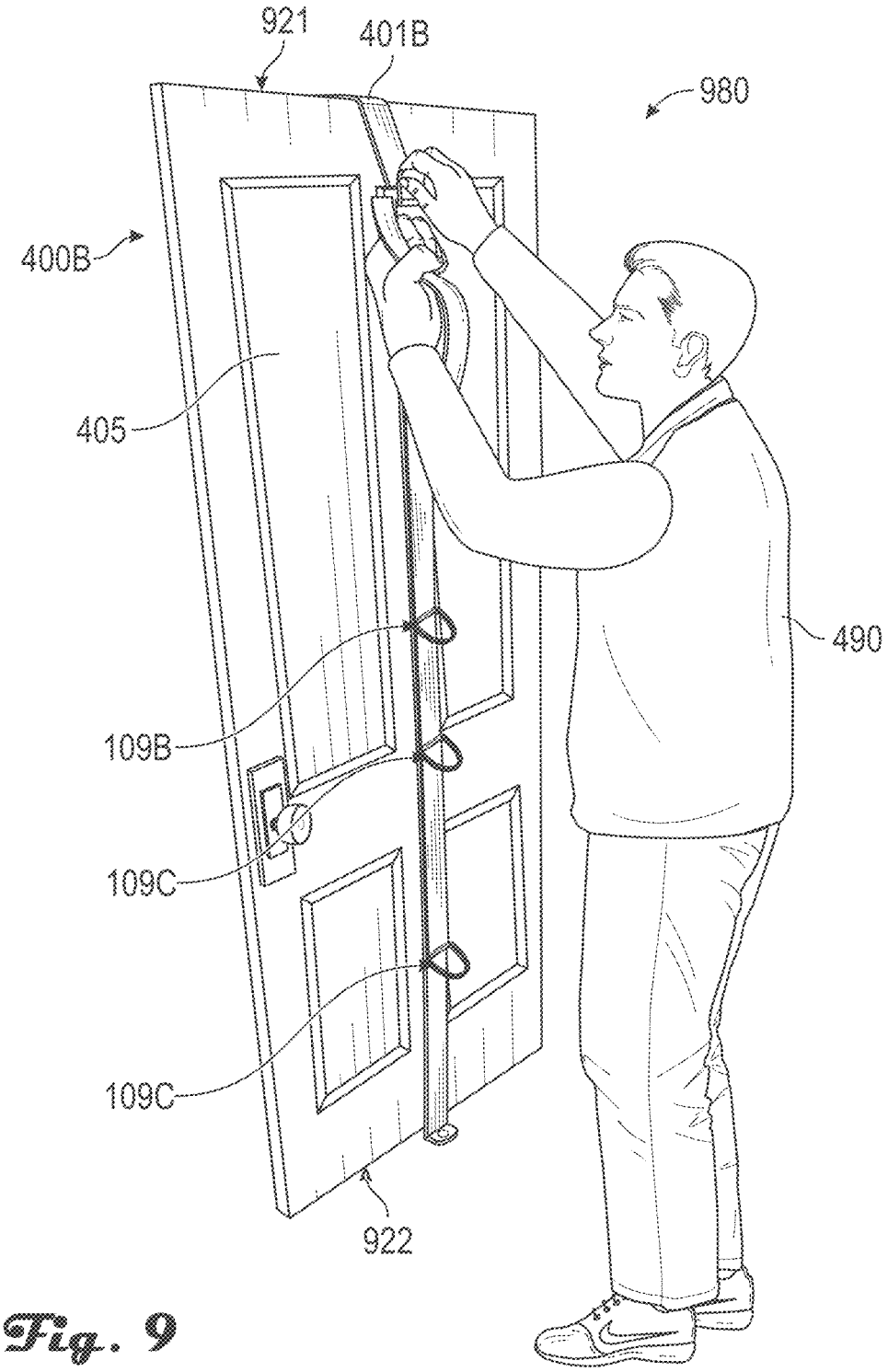
FIG. 9 illustrates a configuration of an exercise system being installed onto a door, in which one or more technologies may be implemented.

FIG. 9 depicts another system 400B (as an instance of the system 400 of FIG. 4, e.g.) configured to repurpose an indoor space to facilitate exercises performed by one or more users 490. In addition to one or more features depicted in FIGS. 1-8 above (this instance of) primary member 160, 560, 660 includes a series of several loops 109B-D (metal D-rings, e.g.) anchored to the primary member and spanning a vertical range 175 greater than one meter. As shown the substantially inelastic strap(s) 401B of system 400B wrap around door 405 from top 921 to bottom 922. Padding or other cushioning (generally like that of FIG. 5, e.g.) is glued, sewn or otherwise affixed onto the tightening mechanism 980, causing the mechanism not to damage the door 405 even when suddenly released.

Figure 10:
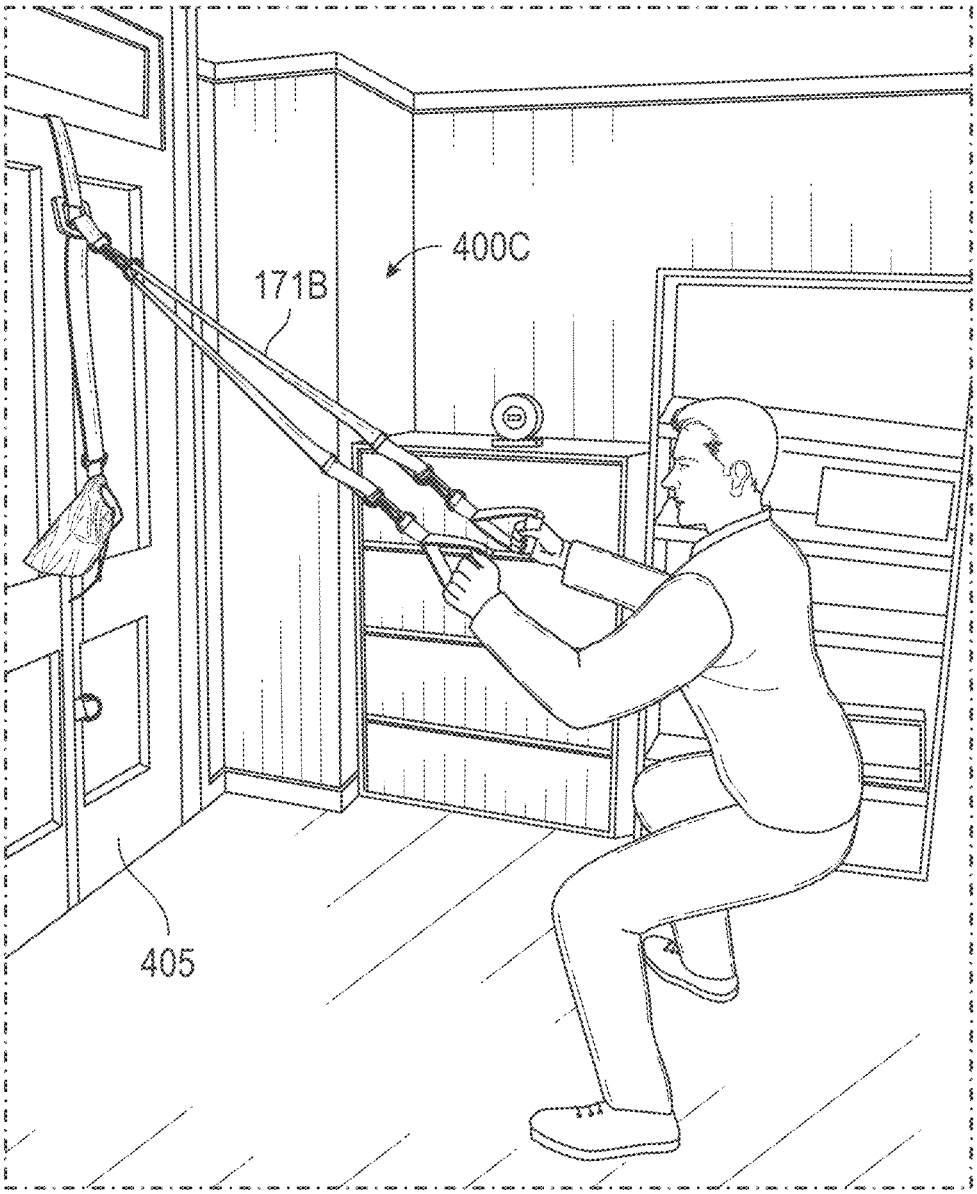
FIG. 10 illustrates a configuration of a door-mounted exercise system being used for a closed-chain exercise, in which one or more technologies may be implemented.

FIG. 10 depicts another system 400C (as an instance of the system 400 of FIG. 4, e.g.) configured to repurpose an indoor space to facilitate exercises performed by one or more users 490. In addition to one or more features depicted in FIGS. 1-9 above (this instance of) primary member 160, 560, 660 is attached (via one or more loops 109, e.g.) to one or more substantially inelastic extensions 171B and supporting the user 490 while performing an assisted squat.

Figure 11:
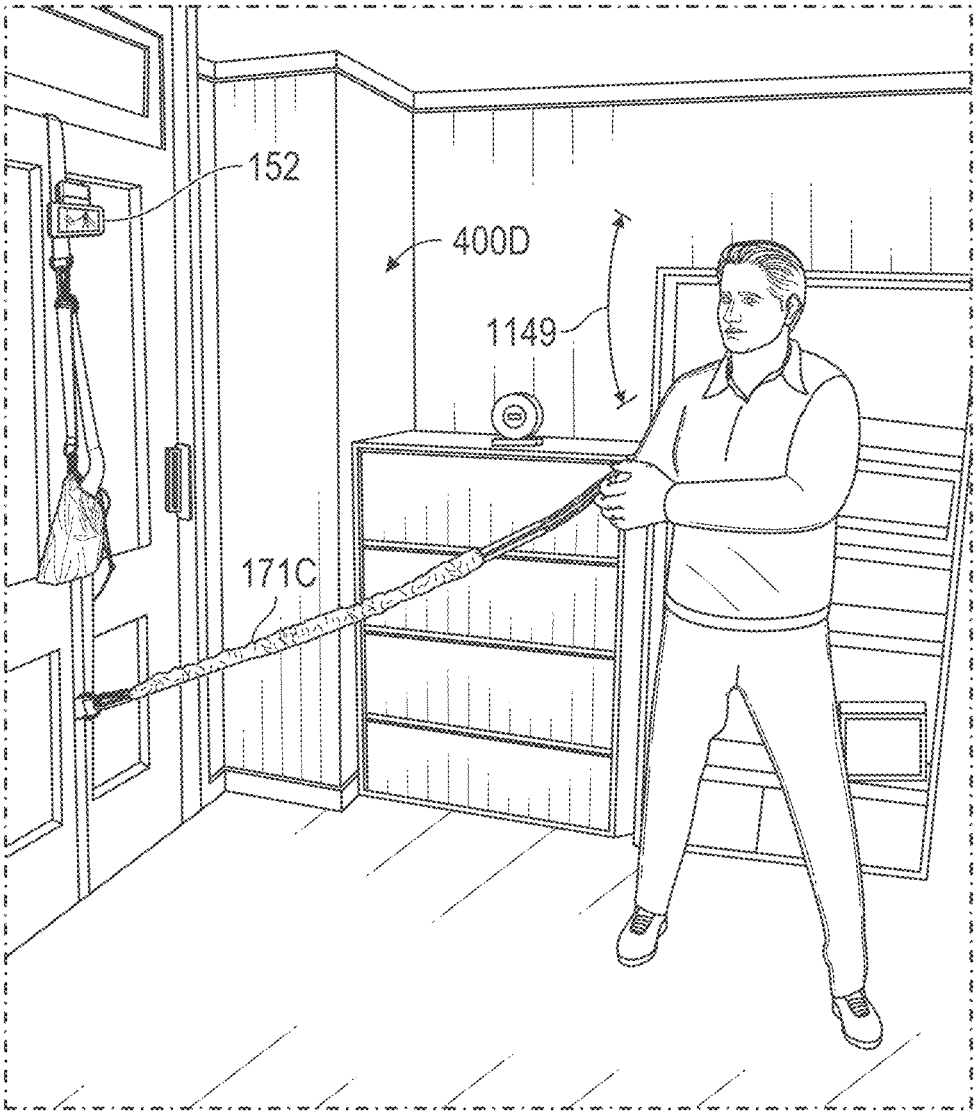
FIG. 11 illustrates a configuration of a door-mounted exercise system being used for an open-chain exercise, in which one or more technologies may be implemented.

FIG. 11 depicts another system 400D (as an instance of the system 400 of FIG. 4, e.g.) configured to repurpose an indoor space to facilitate exercises performed by one or more users 490. In addition to one or more method or system features described with reference to FIGS. 1-10 above (this instance of) primary member 160, 560, 660 is attached (via one or more loops 109, e.g.) to one or more (nominally) elastic extensions 171C and supporting the user 490 while setting up to perform a woodchopper (exercise). In addition to contemporaneous visual guidance 152 within a field of view 1149 of user 490 during a performance of a particular exercise, in some variants timely prior safety information 154 may be provided. For example such safety information 154 may (optionally) include, when first unwrapping elastic extensions 171C for use, a warning not to use them for substantially supporting the user 490 (in an assisted squat, e.g., as shown in FIG. 10).

Figure 12:
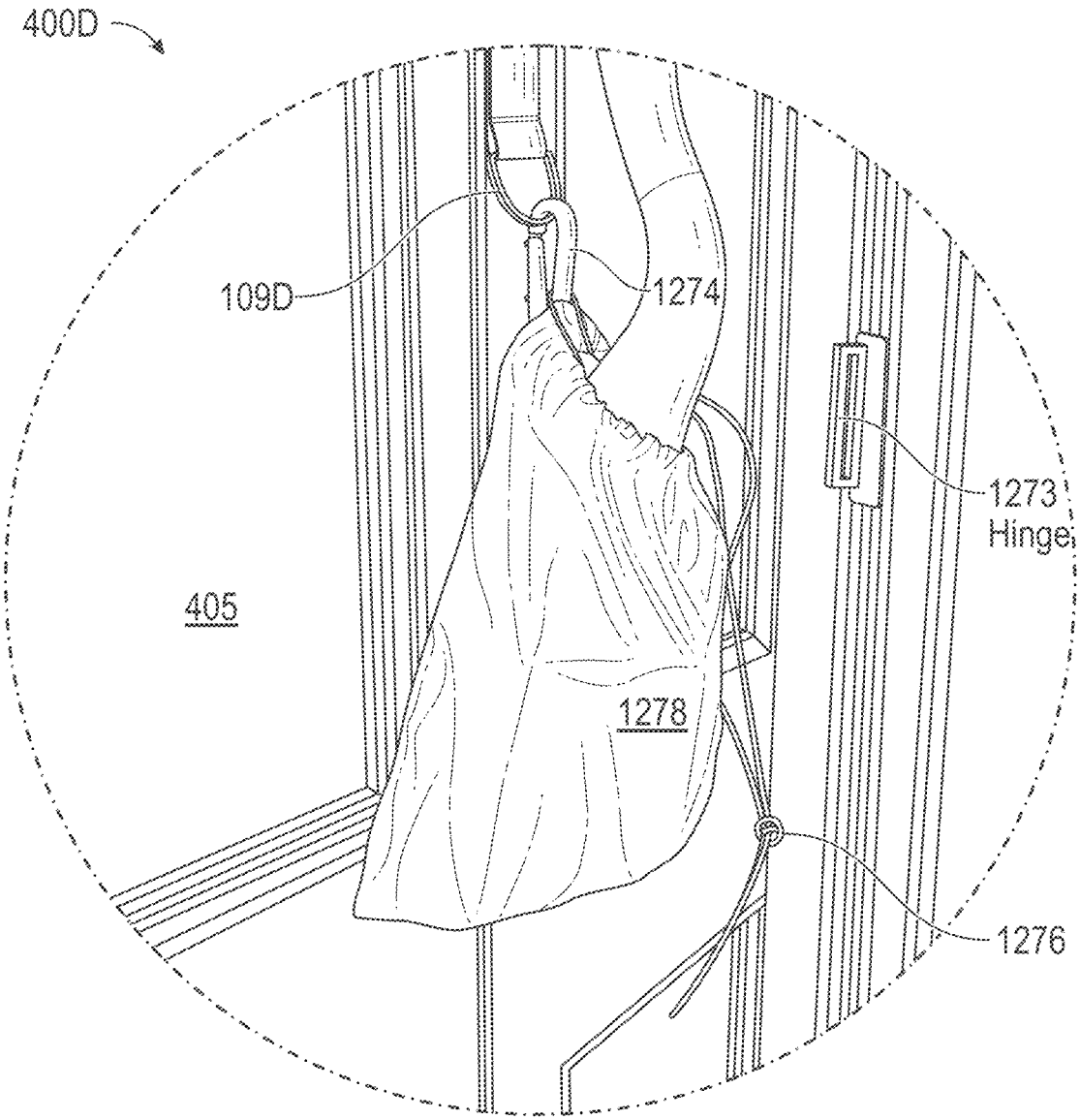
FIG. 12 illustrates a configuration of a highly portable and rugged door-mountable exercise system that can be contained in a small bag with a drawstring, in which one or more technologies may be implemented.

FIG. 12 depicts a magnified view of the system 400D of FIG. 11. As shown a bag 1278 smaller than 30 centimeters in diameter is configured to contain (some variants of) systems described herein. The containment bag 1278 with a drawstring 1276 is (directly or otherwise) attached to a carabiner 1274 to contain one or more other exercise accessories (extensions 171 not in use, e.g.). In some variants the entire system 400D is prepackaged in such a bag 1278 before its initial use such that the bag 1278 and contents thereof weigh less than 20 newtons (i.e. about 4.5 lbs.) in total. This appropriately balances portability with durability in robust variants, for example, (1) in which a contiguous or other metal component of the primary member 160, 560, 660 as described herein weighs more than 20% of the total bag and contents, (2) in which a contiguous or other polymer component of the primary member 160, 560, 660 weighs more than 30% of the total, (3) in which all of the substantially inelastic straps 101, 401 thereof together weigh more than 40% of the total, (4) in which the primary member 160, 560, 660 weighs more than 80% of the total, or (5) more than one of the above. In many contexts such features allow a safe implementation of one or more systems 100, 400 even when configured to facilitate exercise by a user while on a side of the door 405 (as shown) on which hinges 1273 of the door 405 are visible to the user while exercising.

In some variants the bag 1278 may contain the one or more substantially inelastic straps 401, the one or more extensions 171, and the force-multiplying tightening mechanism with the bag 1278 weighing less than 20 newtons. This can occur, for example, in a context in which the one or more straps weigh more than 40% of (a weight of) the total bag and contents (i.e. as a "kit"); in which the primary member weighs more than 80% of (the weight of) the total bag and contents; and in which the kit would otherwise be too heavy or clumsy for travelers or too flimsy for use by adults.

In light of teachings herein, numerous existing techniques may be applied for configuring special-purpose circuitry or other structures effective for facilitating exercise as described herein without undue experimentation. See, e.g., U.S. Pat. No. 9,656,111 ("Climbing wall configuration systems and methods"); U.S. Pat. No. 8,038,581 ("Climbing wall assembly"); U.S. Pat. No. 7,963,368 ("Suspended anchored climbing device with safety features"); U.S. Pat. No. 6,908,418 ("Door mounted deadman for exercise devices"); U.S. Pat. No. 6,322,483 ("Adjustable strap and band exercise device mountable on door"); U.S. Pub. No. 20170348583 ("Wearable technology for enhancing kinesthetic performance"); U.S. Pub. No. 20150099613 ("Wall structure for exercising and attaching fitness and physical activity elements"); U.S. Pub. No. 20130184124 ("Portable modular hanging and pulling system"); and U.S. Pub. No. 20040087420 ("Door/wall/natural structure exerciser anchor").

With respect to the numbered clauses and claims expressed below, those skilled in the art will appreciate that recited operations therein may generally be performed in any order. Also, although various operational flows are presented in a sequence(s), it should be understood that the various operations may be performed in other orders than those which are illustrated or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise. Also in the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Clauses 1. (Independent) A method for using a system (depicted in one or more of FIGS. 1-12 herein, e.g.) to engage a door 105, 405 and thereby to (enable or otherwise) facilitate one or more athletic exercises, the method comprising:

positioning one or more substantially inelastic straps 101, 401 wider than 2.5 centimeters in contact with a top 121, 421, 921 of and with a bottom 122, 922 of the door 105, 405, wherein the one or more substantially inelastic straps 101, 401 wider than 2.5 centimeters comprise a primary (assembly or other primary) member 160;

engaging the one or more substantially inelastic straps 101, 401 with a force-multiplying tightening mechanism 180, 580 adjacent one or more cushions 503 between the force-multiplying tightening mechanism 180, 580 and the door 105, 405;

actuating the force-multiplying tightening mechanism 180, 580 so as to exert longitudinal leverage 115 upon the primary (assembly or other primary) member 160 around the top 121, 421, 921 of and the bottom 122, 922 of the door 105, 405 and thereby to exert a static tension 191 greater than 10 newtons therebetween; and attaching one or more extensions 171A-C onto a first loop 109, 609 so as to complete an assembly of the system, wherein the one or more substantially inelastic straps 101, 401 includes a series of several loops 109, 609 at various vertical positions spanning a vertical range 175 greater than one meter along the one or more substantially inelastic straps 101, 401 and wherein the several loops 109 at various vertical positions include the first loop 109, 609.

2. The method of claim 1, wherein the force-multiplying tightening mechanism 180, 580 is a single contiguous force-multiplying assembly having a total mass exceeding 200 grams; wherein the one or more cushions 503 between the force-multiplying tightening mechanism 180, 580 and the door 105, 405 includes a first cushion 503; wherein the first tightening mechanism 180, 580 is (adhesed or otherwise) affixed to a first cushion 503 thick enough to prevent the first tightening mechanism 180, 580 from touching or damaging the door 405 even after a lateral displacement force of more than 50 newtons exerted via one or more extensions 171A-C is suddenly released by a user 190, 490; and wherein such a massive first tightening mechanism 180, 580 would otherwise damage the door 405 after being suddenly released.

3. The method of any of the above CLAUSES, wherein a first cushion 503 of the one or more cushions 503 comprises a viscoelastic layer.

4. The method of any of the above CLAUSES, wherein a first cushion 503 of the one or more cushions 503 comprises a fabric padding layer.

5. The method of any of the above CLAUSES, wherein a first cushion 503 of the one or more cushions 503 comprises one or more layers having a median thickness 577 of at least about 1 millimeter.

6. The method of any of the above CLAUSES, wherein a first cushion 503 of the one or more cushions 503 comprises one or more layers having a median thickness 577 of about 1 millimeter.

7. The method of any of the above CLAUSES, comprising:

synchronizing a performance of a first series of exercises (reps of an assisted squat, e.g.) of the one or more athletic exercises with visual guidance 152 pertaining specifically to the first exercise via a mobile device 300 while the mobile device 300 is mechanically supported (directly or otherwise) by the one or more substantially inelastic straps 101, 401.

8. The method of any of the above CLAUSES, comprising:

synchronizing a performance of a first series of exercises of the one or more athletic exercises with visual guidance 152 pertaining specifically to the first exercise via a mobile device 300 while the mobile device 300 is mechanically supported by a mounting 896 mechanically supported (directly or otherwise) by the one or more substantially inelastic straps 101, 401.

9. The method of any of the above CLAUSES, comprising:

synchronizing a performance of a first series of exercises of the one or more athletic exercises with visual guidance 152 pertaining specifically to the first exercise via a mobile device 300 while the mobile device 300 is mechanically supported by a plurality of grippers 899 of a mounting 896 mechanically supported by the one or more substantially inelastic straps 101, 401.

10. The method of any of the above CLAUSES, comprising:

synchronizing a performance of a first series of exercises of the one or more athletic exercises with visual guidance 152 pertaining specifically to the first exercise via a mobile device 300 while the mobile device 300 is mechanically supported by a plurality of grippers 899 of a mounting 896 mechanically supported by the one or more substantially inelastic straps 101, 401, wherein the mounting 896 is a casing 796 configured (at least partly) to cover the force-multiplying tightening mechanism 180, 580.

11. The method of any of the above CLAUSES, comprising:

synchronizing a performance of a first series of exercises of the one or more athletic exercises with visual guidance 152 pertaining specifically to the first exercise via a mobile device 300 while the mobile device 300 is mechanically supported by a plurality of grippers 899 of a mounting 896 mechanically supported by the one or more substantially inelastic straps 101, 401, wherein the mounting 896 is a casing 796 configured (at least partly) to cover the force-multiplying tightening mechanism 180, 580 and wherein the mobile device 300 is within a field of view 1149 of a user 190, 490 performing the first series of exercises.

12. The method of any of the above CLAUSES, comprising:

synchronizing a performance of a first series of exercises (reps of a wood chopper exercise, e.g.) of the one or more athletic exercises with auditory guidance 151 pertaining specifically to the first exercise via a mobile device 300 while the mobile device 300 is mechanically supported by the one or more substantially inelastic straps 101, 401.

13. The method of any of the above CLAUSES, comprising:

synchronizing a performance of a first series of exercises of the one or more athletic exercises with auditory guidance 151 pertaining specifically to the first exercise via a mobile device 300 while the mobile device 300 is mechanically supported by a mounting 896 mechanically supported by the one or more substantially inelastic straps 101, 401.

14. The method of any of the above CLAUSES, comprising:

synchronizing a performance of a first series of exercises of the one or more athletic exercises with auditory guidance 151 pertaining specifically to the first exercise via a mobile device 300 while the mobile device 300 is mechanically supported by a plurality of grippers 899 of a mounting 896 mechanically supported by the one or more substantially inelastic straps 101, 401.

15. The method of any of the above CLAUSES, comprising:

synchronizing a performance of a first series of exercises of the one or more athletic exercises with auditory guidance 151 pertaining specifically to the first exercise via a mobile device 300 while the mobile device 300 is mechanically supported by a plurality of grippers 899 of a mounting 896 mechanically supported by the one or more substantially inelastic straps 101, 401, wherein the mounting 896 is a casing 796 configured (at least partly) to cover the force-multiplying tightening mechanism 180, 580.

16. The method of any of the above CLAUSES, comprising:

performing a first series of closed-chain exercises as a component of the one or more athletic exercises so as to cause dynamic tension 192 on the order of 1 kilonewton upon the primary (assembly or other primary) member 160 around the top 121, 421, 921 of and the bottom 122, 922 of the door 105, 405.

17. The method of any of the above CLAUSES, comprising:

performing a first series of open-chain exercises as a component of the one or more athletic exercises so as to cause dynamic tension 192 on the order of 1 kilonewton upon the primary member 160 and around the top 121, 421, 921 of and the bottom 122, 922 of the door 105, 405.

18. The method of any of the above CLAUSES, wherein the one or more substantially inelastic straps 101, 401 are wider than 3 centimeters.

19. The method of any of the above CLAUSES, wherein at least one of the one or more substantially inelastic straps 101, 401 has a (nominal) thickness 579 of about 1 millimeter.

20. The method of any of the above CLAUSES, wherein the system 100, 400 is configured so that all athletic exercises in which a primary member 560 is used are performed with only one strap 401A engaging the door 405 (i.e. with a single inelastic strap 401A engaging both the top 121 and bottom 122 of the door).

21. The method of any of the above CLAUSES, wherein (at least) the one or more cushions 503 between the force-multiplying tightening mechanism 180, 580 and the door 105, 405 prevent the force-multiplying tightening mechanism 180, 580 from touching the door 105, 405 and wherein the one or more cushions 503 are made of padding having a median thickness 777 greater than 1 millimeter.

22. The method of any of the above CLAUSES, wherein the force-multiplying tightening mechanism 180, 580 comprises one or more levers 181, one or more teeth 188 of one or more gears 189, and one or more pawls 187 configured to engage at least one of the one or more teeth; and wherein at least one of the levers 181 is configured to advance at least one of the one or more gears 189 so as to tighten at least one of the one or more substantially inelastic straps 101, 401 and thereby create a static tension 191 greater than 10 newtons.

23. The method of any of the above CLAUSES, wherein the force-multiplying tightening mechanism 180, 580 comprises one or more levers 181 configured to engage a ratchet 185 having a pawl 587 configured to engage a rotary succession of ten or more teeth 588 surrounding a gear 189; wherein the force-multiplying tightening mechanism 180, 580 is factory-built as a single contiguous hinged force-multiplying assembly having a total mass exceeding 200 grams; and wherein the teeth 588 are sufficiently numerous so that each is configured to limit (in conjunction with the pawl 587) a backward rotation of the gear 189 to an angular amount less than 45 degrees.

24. The system constructed and arranged according to any of the CLAUSES as described above.

25. The system constructed and arranged according to CLAUSE 24, further comprising one or more substantially inelastic extensions 171B configured to support a user 490 while performing an assisted squat.

26. The system constructed and arranged according to CLAUSE 24, further comprising one or more substantially inelastic extensions 171B configured to support a user 490 while performing an assisted squat, wherein the one or more substantially inelastic extensions 171B is an additional substantially inelastic strap (e.g. as depicted in FIG. 10).

While various system, method, article of manufacture, or other embodiments or aspects have been disclosed above, also, other combinations of embodiments or aspects will be apparent to those skilled in the art in view of the above disclosure. The various embodiments and aspects disclosed above are for purposes of illustration and are not intended to be limiting, with the true scope and spirit being indicated in the final claim set that follows.

What is claimed is:

1. A method for using a system to engage a door and thereby to facilitate one or more athletic exercises, said method comprising:

positioning one or more substantially inelastic straps wider than 3 centimeters and having a thickness of about 1 millimeter in contact with a top of and with a bottom of said door, wherein said one or more substantially inelastic straps wider than 3 centimeters comprise a primary member;

engaging said one or more substantially inelastic straps with a force-multiplying tightening mechanism with one or more cushions between said force-multiplying tightening mechanism and said door, wherein said one or more cushions between said force-multiplying tightening mechanism and said door prevent said force-multiplying tightening mechanism from damaging said door and wherein said one or more cushions have a median thickness greater than 1 millimeter and comprise a fabric padding layer;

actuating said force-multiplying tightening mechanism so as to exert longitudinal leverage upon said primary member and around said top of and said bottom of said door, wherein said one or more substantially inelastic straps includes a series of several loops at various vertical positions spanning a vertical range greater than one meter along said one or more substantially inelastic straps and wherein said series of several loops at said various vertical positions includes a first loop; wherein said force-multiplying tightening mechanism comprises one or more levers configured to engage a ratchet having a pawl configured to engage a rotary succession of ten or more teeth of a gear; wherein said pawl is configured to engage said ten or more teeth in succession when said force-multiplying tightening mechanism is being tightened; wherein at least one of said one or more levers is configured to respectively advance said gear so as to tighten at least one of said one or more substantially inelastic straps and thereby to create a static tension greater than 10 newtons;

attaching one or more extensions onto said first loop so as to complete an assembly of said system; and performing a first series of open-chain exercises as a component of said one or more athletic exercises so as to cause dynamic tension on an order of magnitude of 1 kilonewton upon said primary member and around the top of and the bottom of the door.

2. The method of claim 1, wherein the one or more extensions comprises an inelastic extension and an elastic extension, the method further comprising:

performing a first subset of said one or more athletic exercises via the inelastic extension attached onto said first loop with said one or more substantially inelastic straps wider than 3 centimeters engaging said door while said door remains closed and while a single strap of said one or more substantially inelastic straps engages both said top of and said bottom of said door; and while said door still remains closed performing a second subset of said one or more athletic exercises via the elastic extension attached onto a second loop of said series of several loops with said one or more substantially inelastic straps wider than 3 centimeters still engaging said door and while said single strap still engages both said top of and said bottom of said door, wherein said single strap is said one or more substantially inelastic straps wider than 3 centimeters, and wherein said first and second subsets of said one or more athletic exercises each cause dynamic tension within an order of magnitude of 1 kilonewton upon said primary member and around said top of and said bottom of said door.

3. The method of claim 1, further comprising:

synchronizing a performance of a first series of exercises of said one or more athletic exercises with visual guidance pertaining specifically to said first series of exercises via a mobile device while said mobile device is mechanically supported by a mounting mechanically supported by said one or more substantially inelastic straps, wherein said mounting includes a casing configured to be at least partly supported by said force-multiplying tightening mechanism and wherein said mobile device is configured to be within a field of view of a user performing said first series of exercises.

4. The method of claim 1, further comprising:

synchronizing a performance of a first series of exercises of said one or more athletic exercises with auditory guidance pertaining specifically to said first series of exercises via a mobile device while said mobile device is mechanically supported by a plurality of grippers of a mounting mechanically supported by said one or more substantially inelastic straps, wherein said mounting is a casing configured to cover said force-multiplying tightening mechanism.

5. The method of claim 1, wherein said force-multiplying tightening mechanism is factory-built as a single contiguous force-multiplying assembly having a total mass exceeding 300 grams; wherein said one or more cushions between said force-multiplying tightening mechanism and said door includes a first cushion; wherein said force-multiplying tightening mechanism is affixed to said first cushion and said first cushion is thick enough to prevent said force-multiplying tightening mechanism from damaging said door even when a lateral displacement force of more than 50 newtons configured to be exerted via said one or more extensions is suddenly released by a user; and wherein said sudden release would otherwise damage said door.

6. The method of claim 1, further comprising:

performing a first series of closed-chain exercises as a component of said one or more athletic exercises so as to cause dynamic tension on the order of magnitude of 1 kilonewton upon said primary member and around said top of and said bottom of said door.

7. The method of claim 1, further comprising:

performing a series of closed-chain exercises as a component of said one or more athletic exercises so as to cause dynamic tension within the order of magnitude of 1 kilonewton upon said primary member and around said top of and said bottom of said door.

8. A method for using a system to engage a door and thereby to facilitate one or more athletic exercises, said method comprising:

positioning one or more substantially inelastic straps wider than 3 centimeters in contact with a top of and with a bottom of said door, wherein said one or more substantially inelastic straps wider than 3 centimeters comprise a primary member;

engaging said one or more substantially inelastic straps with a force-multiplying tightening mechanism with one or more cushions comprising a fabric padding layer between said force-multiplying tightening mechanism and said door;

actuating said force-multiplying tightening mechanism so as to exert longitudinal leverage upon said primary member and around said top of and said bottom of said door, wherein said one or more substantially inelastic straps includes a series of several loops at various vertical positions spanning a vertical range greater than one meter along said one or more substantially inelastic straps and wherein said series of several loops at said various vertical positions includes a first loop;

attaching one or more extensions onto said first loop so as to complete an assembly of said system; and performing a first series of open-chain exercises as a component of said one or more athletic exercises so as to cause dynamic tension on an order of magnitude of 1 kilonewton upon said primary member and around the top of and the bottom of the door.

9. The method of claim 8, wherein at least one of said one or more substantially inelastic straps wider than 3 centimeters has a thickness of about 1 millimeter.

10. The method of claim 8, wherein said one or more cushions between said force-multiplying tightening mechanism and said door prevent said force-multiplying tightening mechanism from damaging said door and wherein said one or more cushions are made of padding having a median thickness greater than 1 millimeter.

11. The method of claim 8, wherein said force-multiplying tightening mechanism comprises one or more levers, ten or more teeth of one or more gears, and one or more pawls configured to engage at least one of said ten or more teeth; and wherein at least one of said one or more levers is configured to respectively advance at least one of said one or more gears so as to tighten at least one of said one or more substantially inelastic straps and thereby to create a static tension greater than 10 newtons.

12. The method of claim 8, wherein said force-multiplying tightening mechanism comprises one or more levers configured to engage a ratchet having a pawl configured to engage a rotary succession of ten or more teeth of a gear; wherein said force-multiplying tightening mechanism is factory-built as a single contiguous hinged force-multiplying assembly having a total mass exceeding 300 grams; and wherein said ten or more teeth are sufficiently numerous so that each is configured to limit a backward rotation of said gear to an angular amount less than 45 degrees.

13. A system configured to engage a door and thereby to facilitate one or more athletic exercises, said system comprising:

one or more substantially inelastic straps wider than 3 centimeters positioned in contact with a top of and with a bottom of said door; wherein said one or more substantially inelastic straps wider than 3 centimeters comprise a primary member, wherein said one or more substantially inelastic straps are engaged with a force-multiplying tightening mechanism with one or more cushions comprising a fabric padding layer between said force-multiplying tightening mechanism and said door; wherein said force-multiplying tightening mechanism is actuated so as to exert longitudinal leverage upon said primary member and around said top of and said bottom of said door and thereby to exert a static tension greater than 10 newtons therebetween; wherein said one or more substantially inelastic straps includes a series of several loops at various vertical positions spanning a vertical range greater than one meter along said one or more substantially inelastic straps and wherein said series of several loops at said various vertical positions includes a first loop; and one or more extensions attached onto said first loop so as to complete an assembly of said system wherein said system is configured so that a first series of open-chain exercises performed as a component of said one or more athletic exercises causes dynamic tension on an order of magnitude of 1 kilonewton upon said primary member and around the top of and the bottom of the door.

14. The system of claim 13, wherein said one or more substantially inelastic straps, said one or more extensions, and said force-multiplying tightening mechanism are all configured to fit into a bag smaller than 30 centimeters in diameter with said bag and contents thereof weighing less than 20 newtons; wherein said one or more substantially inelastic straps wider than 3 centimeters weigh more than 40% of a weight of said total bag and contents; and wherein said system further comprises said bag.

15. The system of claim 13, wherein a single strap of said one or more substantially inelastic straps engages both said top and said bottom of said door, wherein said single strap is said one or more substantially inelastic straps wider than 3 centimeters, and wherein said system further comprises said door.

* * * * *